US005924630A

United States Patent [19]

Brookhart, Jr. et al.

[11] Patent Number: 5,924,630

[45] **Date of Patent: *Jul. 20, 1999**

[54] PRECAST REINFORCED CONCRETE RAILWAY CROSSING SLAB

[75] Inventors: George Clinton Brookhart, Jr.; James A. Baker, both of Littleton; Paul B. Miller, Highlands Ranch, all of Colo.

[73] Assignee: Oldcastle Precast, Inc., Littleton, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/897,391

[22] Filed: Jul. 21, 1997

[51] Int. Cl.[6] ..... E01C 9/04

[52] U.S. Cl. ..... 238/8

[58] Field of Search ..... 238/7, 8

[56] References Cited

U.S. PATENT DOCUMENTS

| | | | |
|---|---|---|---|
| 3,317,137 | 5/1967 | Harmon | 238/8 |
| 3,612,394 | 10/1971 | Gagnon | 238/8 |
| 4,641,779 | 2/1987 | O'Brien et al. | 238/7 |
| 4,899,933 | 2/1990 | Martin | 238/8 |
| 4,911,360 | 3/1990 | Spurr | 238/5 |
| 5,181,657 | 1/1993 | Davis | 238/8 |
| 5,353,987 | 10/1994 | Kusakabe et al. | 238/25 |
| 5,535,948 | 7/1996 | Williams | 238/8 |
| 5,626,289 | 5/1997 | Demers, Jr. et al. | 238/8 |

*Primary Examiner*—S. Joseph Morano

[57] ABSTRACT

The present invention discloses a precast railway crossing slab adapted to extend transversely across the surface of conventional railway ties, with slots or gaps dimensioned and disposed to receive a pair of railway rails therethrough. The crossing slab includes a post-tensioning system in which metal cable strands or tendons are sheathed within plastic tubes and are positioned in the slab mold frame prior to pouring of concrete. Tendon anchors are also disposed in the slab mold frame prior to pouring. After the concrete hardens, a hydraulic jack is used to tension and anchor the tendons in a stressed condition, thus providing reinforcement to the slab. The railway crossing slab of the present invention may be utilized with or without surface or edge metal plating. Flange way fillers which typically comprise rubber strips extending between the sidewalls of the metal rail and the concrete slab may optionally be employed. The slab may be formed integrally with grooves to receive the rails, or alternatively may take the form of three separate slabs provided with screw holes for securement to conventional wooden or concrete railway ties.

13 Claims, 2 Drawing Sheets

PRECAST REINFORCED CONCRETE RAILWAY CROSSING SLAB

BACKGROUND OF THE INVENTION

1. Field Of The Invention

The present invention relates to railway crossings and more particularly pertains to a precast reinforced concrete railway crossing slab of the type employed to facilitate vehicle traffic along a paved roadway across rail lines.

2. Description Of The Prior Art

The prior art includes a variety of prefabricated panel systems adapted for use in the construction of railway crossings. Examples of such prior art railway crossing systems are disclosed in U.S. Pat. No. 4,641,779, issued Feb. 10, 1987; U.S. Pat. No. 4,911,360, issued Mar. 27, 1990; U.S. Pat. No. 5,181,657, issued Jan. 26, 1993; U.S. Pat. No. 5,535,948, issued Jul. 16, 1996; and U.S. Pat. No. 5,626,289, issued May 6, 1997. The entire disclosures of each of the aforementioned patents are hereby incorporated by reference herein.

SUMMARY OF THE INVENTION

The present invention discloses a precast railway crossing slab system including one or more precast concrete slabs or panels adapted to extend transversely across the surface of conventional railway ties, with slots or gaps dimensioned and disposed to receive a pair of railway rails therethrough. The crossing slab includes a post-tensioning system in which metal cable strands or tendons are sheathed within plastic tubes and are positioned in the slab mold frame prior to pouring of concrete. Tendon anchors are also disposed in the slab mold frame prior to pouring. After the concrete hardens, a hydraulic jack is used to tension and anchor the tendons in a stressed condition, thus providing reinforcement to the slab. The railway crossing slab of the present invention may be utilized with or without surface or edge metal plating. Flange way fillers which typically comprise rubber strips extending between the sidewalls of the metal rail and the concrete slab may optionally be employed. The slab may be formed integrally with grooves to receive the rails, or alternatively may take the form of three separate slabs provided with screw holes for securement to conventional wooden or concrete railway ties.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
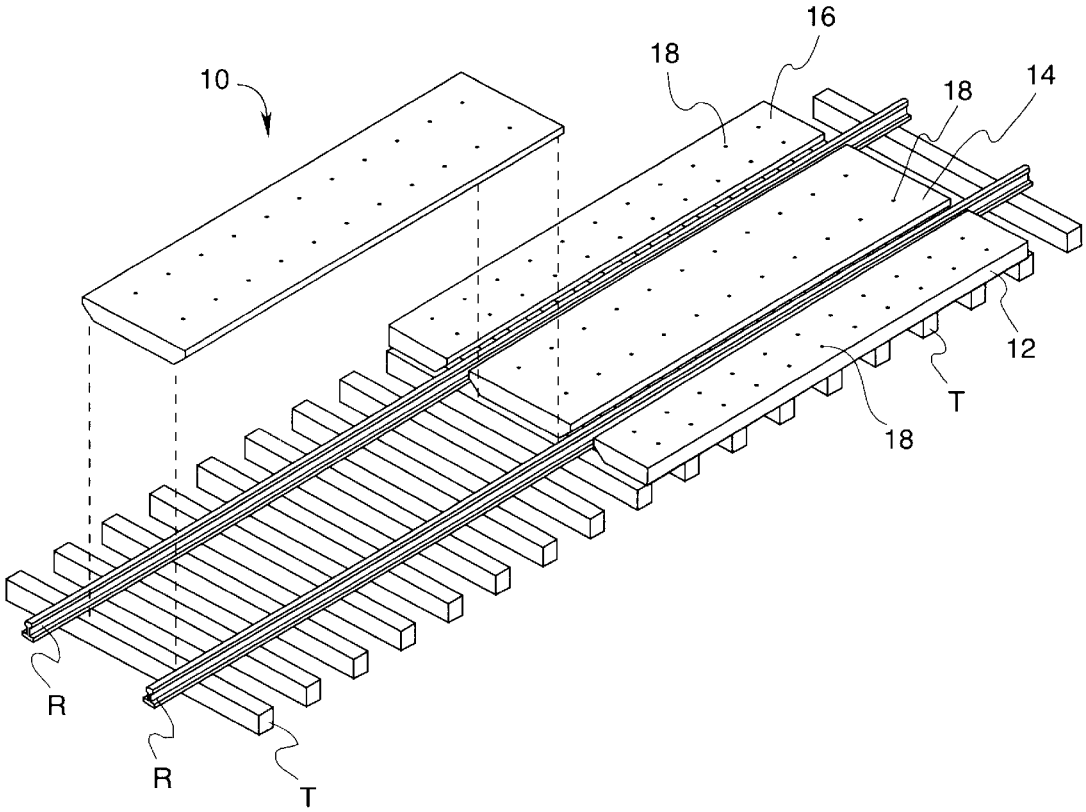
FIG. 1 is a diagrammatic perspective view illustrating a railway crossing slab system according to the present invention and the manner of installing the same.

Referring now to the drawings, wherein like reference numerals designate corresponding structure throughout the views, and referring in particular to FIG. 1, a railway crossing slab system 10 according to the present invention may be formed as an integral slab or panel provided with grooves or slots for receipt of conventional rails R, or as shown in FIG. 1, as three separate slabs or panels 12, 14, and 16 adapted for securement in a transverse manner to conventional wooden ties T by the use of screws (not shown) extending through holes 18 spaced along and extending through each of the slabs 12, 14, and 16.

Figure 2:
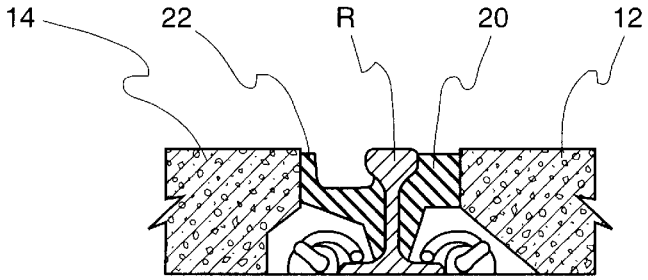
FIG. 2 is a cross-sectional detail view illustrating the optional use of flange way filler strips with the slab system of the present invention.

As shown in FIG. 2, flange way filler strips 20 and 22 may be provided to substantially fill the gap between the edges of slabs 12 and 14 and the rail R for the purpose of preventing dirt and water from entering the gap. Such flange way fillers are well known in the art.

With reference to FIG. 1, the upper surface of the ties T are not generally disposed in a common plane due to irregularities in the ground surface and shifting of the ties over time due to weight of passing trains and seasonal freezing and thawing. Deflection of the ties provides a great deal of stress to railway crossing slabs secured to or supported on the surface of such ties. Such stresses typically result in cracking and ultimately in the failure of the prior art crossing slabs.

Figure 3:
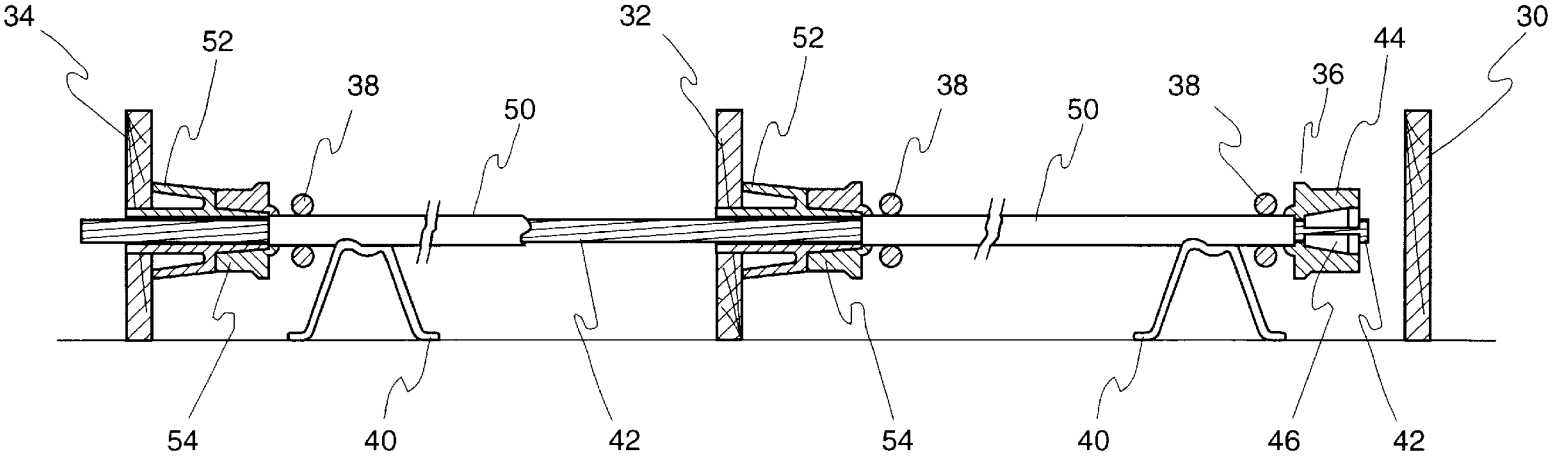
FIG. 3 is a side elevational view illustrating a post-tensioning system installed in a mold or frame prior to pouring of concrete for forming the railway crossing slab of the present invention.
Figure 4:
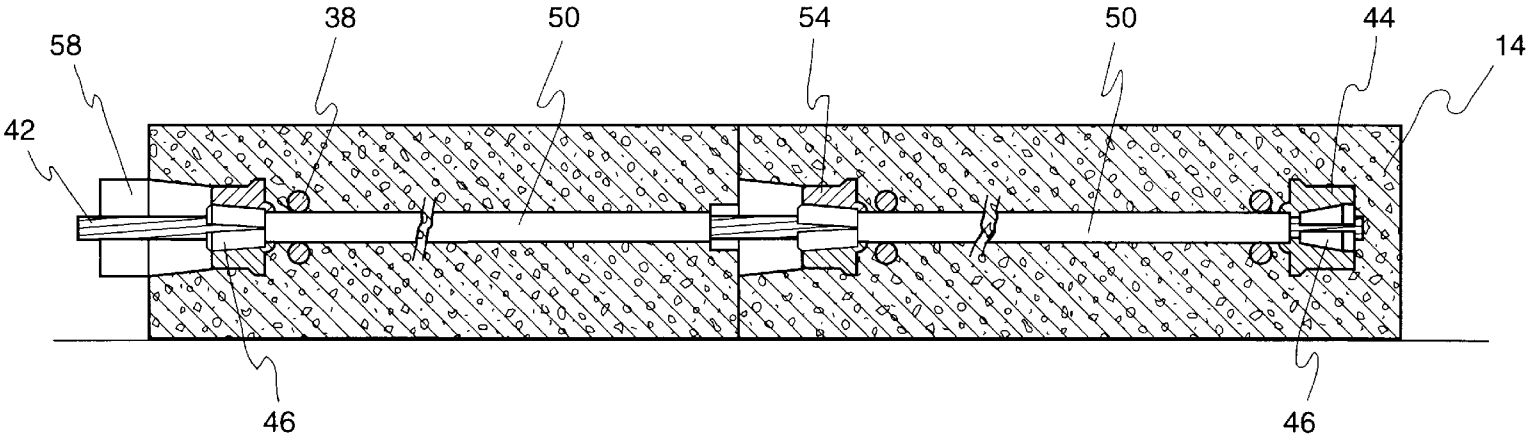
FIG. 4 is a diagrammatic side view illustrating the post-tensioning system disposed within a railway crossing slab according to the present invention.

With reference to FIGS. 3 and 4, the present invention provides an internal post-tensioning system within the body of the precast slab or slabs, for the purpose of reinforcing the slab, particularly by the tensioning of a wire cable or tendon within the slab after hardening. Post-tensioning systems for the reinforcement of concrete buildings such as parking garages are known per se. However, the prior art does not disclose or suggest the use of post-tensioning systems in railway crossing slabs. A preferred post-tensioning system for use in the railway crossing slab of the present invention is available under the name DYWIDAG Monostrand Post-Tensioning System from DYWIDAG INTERNATIONAL, USA, INC. of Bolingbrook, Ill.

With reference to FIG. 3, a slab mold or form includes a plurality of forms 30, 32, and 34 which preferably comprise wooden boards or slats. A dead end anchor 36 includes a collar 44 and wedges 46 which clamp one end of a cable or tendon 42. Cross reinforcing bars 38 and supports 40 position the strand 42 centrally within the form prior to pouring of concrete. Depending upon the length or width of the slab desired, one or more intermediate stressing anchors 54 may be provided, with each including a pocket former 52. A plurality of tendons may be disposed within each panel or slab, depending upon the dimensions of the slab. After the post-tensioning system is properly disposed within the form, concrete is poured in a conventional manner, preferably using vibrating equipment to ensure even distribution of concrete within the form without leaving voids. After pouring and hardening of the concrete, the tendons 42 are tensioned, sliding within plastic sleeves 50, upon application of force by a hydraulic jack. Preferably, the tendon 42 is placed under a tension of about 30,000 pounds. The tendon is then secured in a tensioned condition with wedges, and the excess length cut off using a torch or other cutting implement.

The slab system of the present invention has substantial advantages over the prior art, including greater durability, greater resistance to cracking, less likelihood of damage during handling by forklifts, and also allows use without the provision of metal edging or surface plating required by conventional slab crossing systems. Such metal edging or plating may be optionally employed in conjunction with the present invention if so desired.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed, and reasonable equivalents thereof.

What is claimed is:

1. A railway crossing slab system on a grade crossing including a roadway intersected by a pair of spaced railroad rails supported on ties, said railway crossing slab system comprising:

three precast concrete panels dimensioned and disposed to substantially cover the ties disposed in the space between the rails and on the outer sides of said rails, one of said panels disposed between the rails and the other two of the panels disposed on outer sides of said rails; and each of said panels including a flexible elongated tendon extending within said panel and having a first end connected to a dead end anchor disposed within said panel and a second end connected to an external anchor accessible from an exterior end portion of said panel, said elongated tendon held under a tension of about 30,000 pounds between said dead end anchor and said external anchor.

2. The railway crossing slab system of claim 1, further comprising:

elongated flange way filler strips disposed between the rails and said panels, said strips substantially filling the gap between longitudinal edges of said panels and the adjacent rail for substantially preventing dirt and water from entering said gap.

3. The railway crossing slab system of claim 2, wherein said strips comprise rubber.

4. The railway crossing slab system of claim 1, wherein each of said panels comprise cross reinforcing bars supporting said tendon substantially centrally within said panel.

5. The railway crossing slab system of claim 1, wherein each of said panels comprise an intermediate stressing anchor disposed within said panel between said dead end anchor and said exterior anchor.

6. The railway crossing slab system of claim 1, wherein each of said panels comprise wedges associated with said anchors securing said tendon in tension.

7. The railway crossing slab system of claim 1, wherein each of said panels comprise a sleeve enclosing said tendon in sliding relation therein.

8. The railway crossing slab system of claim 1, wherein each of said panels comprise a metal plating extending along edge portions of said panel.

9. The railway crossing slab system of claim 1, wherein each of said panels comprise a metal plating on a surface of said panel.

10. The railway crossing slab system of claim 1, wherein each of said panels comprise a plurality of screws extending through a plurality of spaced holes in said panel and securing said panel to railroad ties.

11. The railway crossing slab system of claim 1, wherein upper surfaces of the ties underlying said panels are not disposed in a common plane.

12. The railway crossing slab system of claim 1, wherein each of said panels comprise a stepped width longitudinal edge portion on a side of said panel facing a rail.

13. The railway crossing slab system of claim 12, wherein each of said stepped width longitudinal edge portions of said panels comprise a substantially vertical upper most and inner most portion disposed in abutment with a rubber flange way filler strip disposed between each of said panels and an adjacent rail.

* * * * *